US010464718B2

(12) United States Patent
Tan

(10) Patent No.: US 10,464,718 B2
(45) Date of Patent: Nov. 5, 2019

(54) SEALABLE WAVE BAG ASSEMBLY WITH INTEGRATED VENTING

(71) Applicant: Pan Pacific Plastics Mfg., Inc., Hayward, CA (US)

(72) Inventor: Hin Siang Michael Tan, Danville, CA (US)

(73) Assignee: PAN PACIFIC PLASTICS MFG., INC., Hayward, CA (US)

( * ) Notice: Subject to any disclaimer, the term of this patent is extended or adjusted under 35 U.S.C. 154(b) by 240 days.

(21) Appl. No.: 15/388,740

(22) Filed: Dec. 22, 2016

(65) Prior Publication Data

US 2018/0162601 A1 Jun. 14, 2018

Related U.S. Application Data

(63) Continuation-in-part of application No. 15/374,764, filed on Dec. 9, 2016.

(51) Int. Cl.
*B65B 7/02* (2006.01)
*B65D 33/01* (2006.01)
(Continued)

(52) U.S. Cl.
CPC ..... *B65D 33/01* (2013.01); *B65B 7/02* (2013.01); *B65B 43/26* (2013.01); *B65D 31/08* (2013.01);
(Continued)

(58) Field of Classification Search
CPC ..... B65D 33/01; B65D 33/08; B65D 33/18; B65D 33/34; B65D 33/1691; B65D 31/10; B65D 31/145; B65B 5/045; B65B 7/02
(Continued)

(56) References Cited

U.S. PATENT DOCUMENTS 3,088,255 A * 5/1963 Griem ..... B65D 77/24 53/410
3,224,640 A * 12/1965 Schneider ..... B65D 31/12 222/107
(Continued)

FOREIGN PATENT DOCUMENTS

AU 5715973 A 1/1975
BE 829266 9/1975
(Continued)

OTHER PUBLICATIONS

Hin Siang Michael Tan, U.S. Appl. No. 15/374,764, filed Dec. 9, 2016.
(Continued)

*Primary Examiner* — Alexander M Valvis
*Assistant Examiner* — Daniel Jeremy Leeds
(74) *Attorney, Agent, or Firm* — Beyer Law Group LLP

(57) ABSTRACT

A plastic material wave bag assembly having a sheet-like first side panel and a sheet-like second side panel oriented in opposed congruent relationship to one another when in a folded condition. The wave bag assembly includes a single use closure adhesive strip disposed and oriented primarily laterally across an interior wall of the upper panel section of the first side panel at a location below the handle apertures. The closure adhesive strip is configured to selectively close and maintain the upper panel sections in a closed condition while the remaining portions of the first and second side panels are maintained in the receiving condition. The closure adhesive strip includes opposed closure adhesive strip distal ends formed and dimensioned to terminate proximate to a respective corner intersection such that at least one vent passage is formed between a corresponding closure adhesive strip distal end, in the closed condition, and the corresponding upper side edge end portion of the side edge of the first and second side panels. The vent passage is of a lateral
(Continued)

dimension sufficiently large to enable the venting of steam while being sufficiently small to prevent the passage of a human hand therethrough.

8 Claims, 13 Drawing Sheets

(51) Int. Cl.

| | |
|---|---|
| ***B65B 43/26*** | (2006.01) |
| ***B65D 30/18*** | (2006.01) |
| ***B65D 30/20*** | (2006.01) |
| ***B65D 33/08*** | (2006.01) |
| ***B65D 33/16*** | (2006.01) |
| ***B65D 33/34*** | (2006.01) |
| ***B65D 30/22*** | (2006.01) |
| ***B65D 33/18*** | (2006.01) |

(52) U.S. Cl.
CPC ..... *B65D 31/10* (2013.01); *B65D 31/12* (2013.01); *B65D 33/08* (2013.01); *B65D 33/1691* (2013.01); *B65D 33/18* (2013.01); *B65D 33/34* (2013.01)

(58) Field of Classification Search
USPC ..... 53/410
See application file for complete search history.

(56) References Cited

U.S. PATENT DOCUMENTS

| | | | | |
|---|---|---|---|---|
| 3,504,475 | A * | 4/1970 | Hamilton | B65D 33/20 53/410 |
| D241,321 | S | 9/1976 | Paige | |
| 4,125,220 | A | 11/1978 | Suominen | |
| 4,216,899 | A | 8/1980 | Kamp | |
| D258,204 | S | 2/1981 | Rudenschold | |
| 4,566,252 | A * | 1/1986 | Watanabe | B65B 61/16 383/37 |
| 4,717,262 | A | 1/1988 | Roen | |
| 4,759,643 | A * | 7/1988 | Canno | B65D 27/16 383/100 |
| 4,877,335 | A | 10/1989 | Barnard | |
| 4,923,309 | A * | 5/1990 | VanErden | B65D 33/16 383/204 |
| 4,932,791 | A | 6/1990 | Vetter | |
| 4,936,817 | A * | 6/1990 | Runge | B29C 65/18 383/89 |
| 5,045,040 | A | 9/1991 | Vetter | |
| 5,338,118 | A | 8/1994 | DeMatteis | |
| 5,720,557 | A * | 2/1998 | Simonsen | B65D 33/1608 383/61.2 |
| D404,203 | S | 1/1999 | Maier-Aichen | |
| D684,369 | S | 6/2013 | Daigle | |
| D706,030 | S | 6/2014 | Wang | |
| D755,510 | S | 5/2016 | Haast | |
| D782,918 | S | 4/2017 | Ross | |
| D784,157 | S | 4/2017 | Ross | |
| D796,967 | S | 9/2017 | Abang, Jr. | |
| D830,850 | S | 10/2018 | Tan | |
| 2003/0232112 | A1 | 12/2003 | Whitmore | |
| 2004/0042688 | A1 | 3/2004 | Lee | |
| 2006/0017279 | A1 | 1/2006 | Wu | |
| 2007/0031067 | A1 | 2/2007 | Gebhardt | |
| 2008/0063325 | A1 | 3/2008 | Miller et al. | |
| 2008/0247683 | A1 | 10/2008 | Schmal et al. | |
| 2009/0226121 | A1 | 9/2009 | Veder | |
| 2013/0022714 | A1* | 1/2013 | Coderre | B65D 65/466 426/106 |
| 2014/0241847 | A1* | 8/2014 | Short | B65D 33/01 414/800 |
| 2014/0270598 | A1* | 9/2014 | Pang | B65D 33/06 383/207 |
| 2015/0197388 | A1 | 7/2015 | Maglio, Jr. | |
| 2016/0229613 | A1 | 8/2016 | Morofuji | |
| 2017/0166358 | A1* | 6/2017 | Chandaria | B65B 7/02 |

FOREIGN PATENT DOCUMENTS

| | | |
|---|---|---|
| DE | 102013020683 | 12/2013 |
| JP | 2016098039 | 5/1916 |

OTHER PUBLICATIONS

Hin Siang Michael Tan, U.S. Appl. No. 29/611,777, filed Jul. 25, 2017.
Hin Siang Michael Tan, U.S. Appl. No. 15/832,412, filed Dec. 5, 2017.
IPS Industries, "Tamper Safe & Reusable" brochure, www.IPSPI.com, obtained in 2017, prior to Dec. 5, 2017.
Pak Sher, "IntegriLiner" brochure, www.paksher.com, obtained in 2017, prior to Dec. 5, 2017.
Pak Sher, "IntegriBag" brochure, www.paksher.com, obtained in 2017, prior to Dec. 5, 2017.
International Application No. PCT/US2017/064767 filed Dec. 5, 2017.
International Search Report and the Written Opinion, dated Feb. 8, 2018.
Hin Siang Michael Tan, U.S. Appl. No. 29/661,712, filed Aug. 30, 2018.
Office Action, for U.S. Appl. No. 15/832,412, dated Feb. 6, 2018.
Office Action for U.S. Appl. No. 15/832,412, dated Jun. 11, 2018.
Final Office Action for U.S. Appl. No. 15/832,412, dated Nov. 16, 2018.

* cited by examiner

SEALABLE WAVE BAG ASSEMBLY WITH INTEGRATED VENTING

RELATED APPLICATIONS

This application is a continuation-in-part application based upon patent application Ser. No. 15/374,764, filed Dec. 9, 2016, which is entitled "SEALABLE WAVE BAG ASSEMBLY WITH INTEGRATED VENTING", naming Tan as the inventor, and which is incorporated by reference in its entirety.

FIELD OF THE INVENTION

The present invention relates to wave top bags, and more particularly, relates to single use, food service, sealable wave top bags with integrated venting.

BACKGROUND OF THE INVENTION

Plastic bags that have a bell-shaped upper portion and open extra wide at the top to enable quick and easy loading of take-out orders are commonly referred to as wave bags or wave-top bags. Wave bags typically include a folded bottom gusset portion having a wide, flat base that, when unfolded, enables the bag to stand on its own with its mouth wide open to allow for convenient and easy packaging. These bags, hence, are specifically engineered to enable stacking two or more carryout containers therein in a manner significantly preventing tipping and spilling of the container contents. Handles integrated with the wave top, together with low, medium, or high weight plastic material made sometimes with recycled plastic, further increase functionality and value of these bags.

While the use of these wave bags has begun to proliferate in the food service industry, especially with the recent growth of third party food delivery services, the potential for food tampering also increases. Both the food preparer/provider and the consumer would like assurance the food prepared has not in any manner been touched or tampered prior to the delivery.

Accordingly, it is desirable to provide a bell-shaped or wave type bag that is capable of being sealed in a manner that enables the end consumer assurance wave bag has not been opened, and that the prepared food therein has not been tampered with.

SUMMARY OF THE INVENTION

The present invention provides a plastic material wave bag assembly including a sheet-like first side panel and a sheet-like second side panel oriented in opposed congruent relationship to one another when in a folded condition. Each of the first and second side panel is integrally joined together at common, opposed side edges thereof, and includes a respective upper panel section that is defined by respective convexly contoured, generally parabolically shaped top edges. Further, each upper panel section further defines a congruently located handle aperture proximate to a respective apex portion of the respective parabolically shaped top edge. Each parabolically shaped top edge includes a pair of opposed shoulder end portions terminating and intersecting respective upper side edge end portions of a pair of respective opposed side edges of each side panel at respective corner intersections thereof. Each side panel further includes a respective bottom edge oriented in congruent, adjacent relationship to one another, in the folded condition, and cooperatively joined such that a bag interior cavity is formed when the parabolically shaped top edges are generally spaced apart to an opened condition, reorienting the side panels to a receiving condition.

In accordance with the present invention, the wave bag assembly further includes a single use closure adhesive strip disposed and oriented primarily laterally across an interior wall of the upper panel section of at least one of the side panels at a location below the handle apertures. The closure adhesive strip is configured to selectively close and maintain the upper panel sections generally in a closed condition while the remaining portions of the side panels are maintained in the receiving condition to hold content within the bag interior cavity. The closure adhesive strip includes a pair of opposed adhesive strip distal ends formed and dimensioned to terminate proximate to a respective corner intersection of the bag assembly such that a respective vent passage is formed between the adhesive strip distal ends, in the closed condition, and the upper side edge end portions of the opposed side edge of the side panels. Each the vent passage is of a lateral dimension sufficiently large to enable the venting of steam therethrough while being sufficiently small to prevent the passage of a human hand therethrough.

Accordingly, a wave bag assembly is provided that can be easily sealed to prevent tampering, yet provides venting of the contents simply by the positioning of the closure adhesive strip in such a manner to create the vent passages. Moreover, the size of the vent passages, while providing venting of steam for example, is sufficiently small so that delivery personal cannot tamper with the bag contents without tearing of the bag or closure adhesive strip. This wave bag assembly is particularly useful in the food delivery service industry.

In one specific embodiment, the opposed adhesive strip distal ends each terminate at an orientation vertically above the respective corner intersection.

In another specific embodiment, the closure adhesive strip extends generally horizontally across the upper panel section at a vertical orientation above the corner intersections.

Yet another configuration provides that the opposed adhesive strip distal ends each terminate at an orientation vertically below the respective corner intersection. Each opposed adhesive strip distal ends do not intersect any one of the respective opposed side edge and the respective parabolically shaped top edge of the respective side panel.

In still another specific embodiment, the closure adhesive strip tapers upwardly toward the respective apex portion from each the adhesive strip distal end.

Another specific specification provides that the vent passage has a diameter in the range of about 0.5 inch to about 2.5 inches.

In yet another embodiment, the cooperative joining between the respective bottom edges includes a bottom gusset portion positioned therebetween and integrally joined at respective opposed gusset side edges of the gusset portion to a respective bottom edge of the first and second side panel. The gusset portion includes a central fold line that is centrally disposed between lower portions of the first and second side panels, when in the folded condition, and is unfolded to form a generally flat bottom of the wave bag assembly, when in the receiving condition.

Still another embodiment provides that the closure adhesive strip includes a double sided adhesive tape.

Yet another configuration provides that a width of the closure adhesive strip is in the range of about ¼ inch to about ¾ inch. Furthermore the closure adhesive strip, in another embodiment, is continuous from one end portion to an opposite end portion thereof.

In one specific embodiment, the wave bag assembly further includes a single use or multiple use alignment adhesive strip disposed and oriented laterally across the interior wall of the upper panel section of the first side panel. The single use or multiple use alignment adhesive strip is oriented above the handle aperture, and the adhesive strip is configured to selectively align, realign, close and maintain the apex portions of the upper panel sections generally in the closed condition.

Still another configuration provides that the apex portions of the top edges extend generally horizontally and linearly across and above the handle portions.

In one other specific embodiment, at least one of the first side panel and the second side panel includes a perforation oriented below the closure adhesive strip and extending generally from one side thereof to an opposite side thereof.

Another configuration provides opposed ends of the perforation that terminate substantially at the respective parabolically shaped top edge. In another embodiment, the opposed ends of the perforation terminate substantially at the respective common side edge of the first and second side panel.

In another aspect of the present invention, a tamper proof method for transporting one or more food containers is provided comprising is providing a plastic material wave bag assembly having a sheet-like first side panel and a sheet-like side panel oriented in opposed congruent relationship to one another when in a folded condition, and repositioning the wave bag assembly from the folded condition to the opened condition, reorienting the first and second side panels to the receiving condition. The method further includes placing the one or more food containers into the bag interior in the receiving condition. The next step includes single-use, substantially sealing the opposed upper panel sections together to a closed condition, toward the folded condition, while the one or more food containers are maintained in the bag interior in the receiving condition by contacting a single use closure adhesive strip into contact with the opposed interior walls of the opposed upper panel sections.

Similarly, the closure adhesive strip is formed and dimensioned to facilitate the creation of at least one vent passage. The opposed upper panel sections are maintained in the closed condition, and the vent passage is of a lateral dimension sufficiently large to enable the venting of steam therethrough from the bag interior while being sufficiently small to prevent the passage of a human hand therethrough.

In another specific embodiment, before forming the pair of opposed vent passages, aligning the respective apex portions of the upper panel sections together. Next, the method includes contacting a single use or multiple use alignment adhesive strip, disposed on the interior wall of the upper section of the first side panel, oriented above the handle apertures, and into contact with the opposed interior wall of the second side panel.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawings, in which:

DETAILED DESCRIPTION OF THE INVENTION

Figure 1:
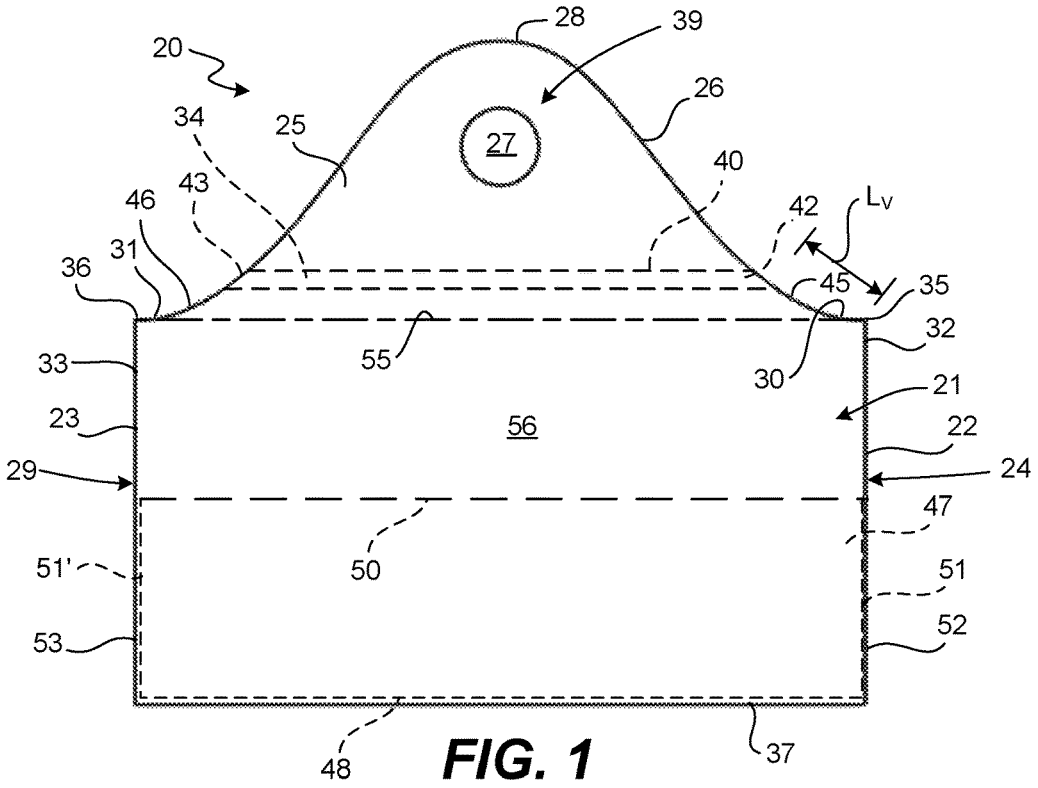
FIG. 1 is a front elevation view of a wave bag assembly constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
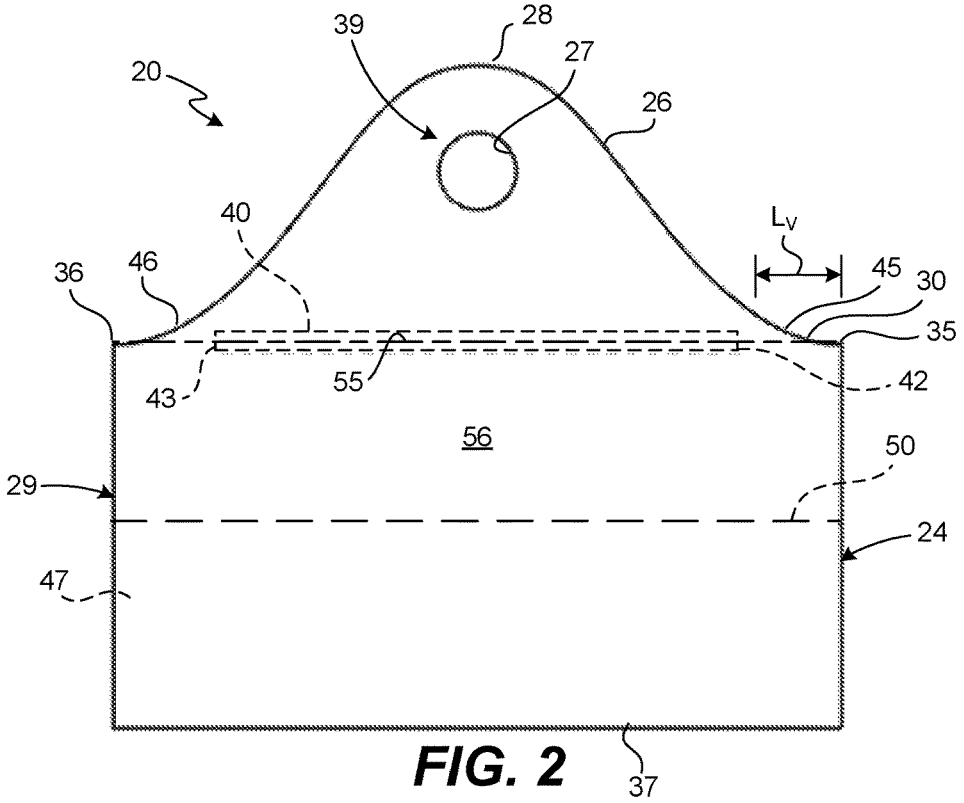
FIG. 2 is a front elevation view of another embodiment of the wave bag assembly with a closure adhesive strip oriented at an alternative position.
Figure 3:
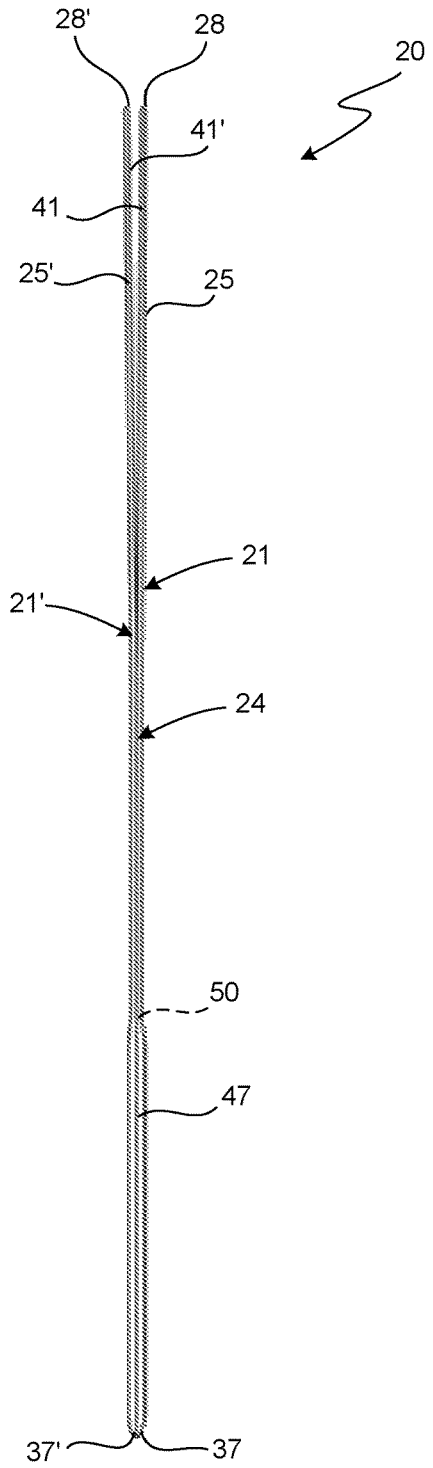
FIG. 3 is a side elevation of the wave bag assembly of FIG. 1.
Figure 4:
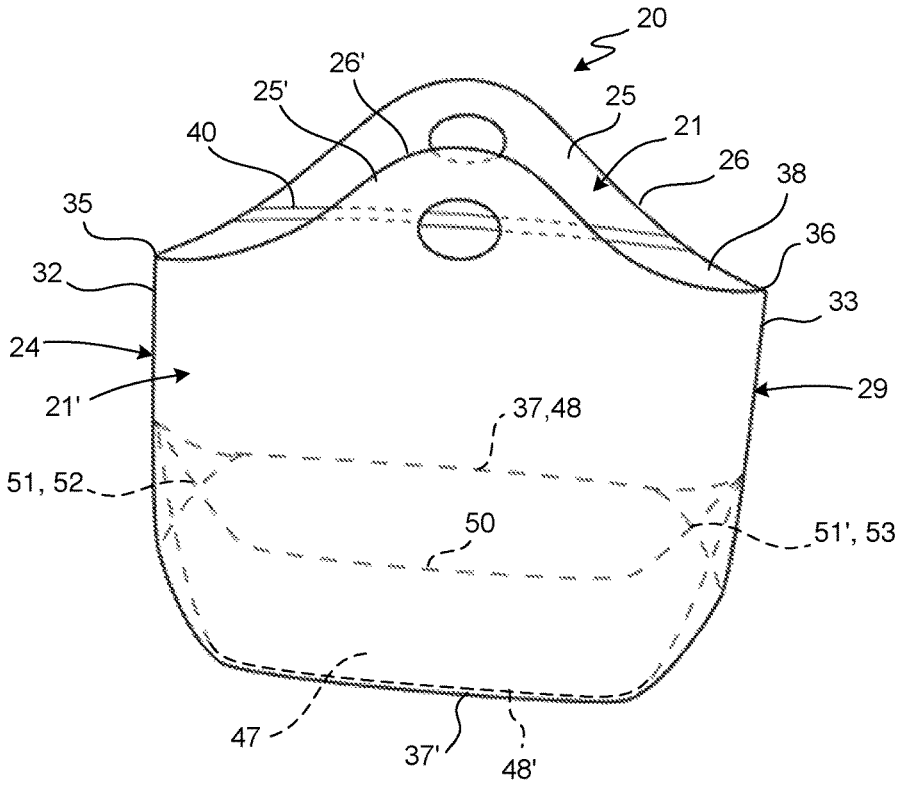
FIG. 4 is a top perspective view of the wave bag assembly of FIG. 1 with the upper sections thereof in an opened condition.

Turning now to FIGS. 1-9, a plastic material wave bag assembly, generally designated 20, includes a sheet-like first side panel 21 and a sheet-like second side panel 21' oriented in opposed congruent relationship to one another when in a folded condition (FIG. 1-3). Each side panel 21, 21' is integrally joined together at common opposing side edges 22, 23 thereof. Further, each side panel includes a respective upper panel section 25, 25' that is defined by respective convexly contoured, parabolically shaped top edges 26, 26', and each upper panel section 25, 25' defines a congruently located handle aperture 27, 27' proximate to a respective apex portion 28, 28' of the respective parabolically shaped top edge 26, 26'. Each parabolically shaped top edge 26, 26' includes a respective pair of opposed shoulder end portions 30, 31 and 30', 31' that terminate and intersect with respective upper side edge end portions 32, 33 of the common opposed side edges 22, 23 of the joined first and second side panel 21, 21' at respective corner intersections 35, 36 thereof. Each of the first and second side panel 21, 21' further includes a respective opposed bottom edge 37, 37' oriented in congruent, adjacent relationship to one another, in the folded condition (FIG. 1-3), and are cooperatively joined such that a bag interior cavity 38 (FIG. 5) is formed when the parabolically shaped top edges 26, 26' are generally spaced apart to an opened condition (FIGS. 5 and 6), reorienting the remaining portions of the side panels 21, 21' to a receiving condition (FIGS. 6-10).

In accordance with the present invention, the wave bag assembly 20 further includes a single use closure adhesive strip 40 disposed and oriented primarily laterally across an interior wall 41, 41' of the upper panel section 25, 25' of at least one of the side panels 21, 21' at a location below the handle apertures 27, 27'. The closure adhesive strip 40 is configured to selectively close and maintain the upper panel sections 25, 25' generally in a closed condition (FIGS. 9 and 10) while the remaining portions of the side panels 21, 21' are maintained in the receiving condition (FIGS. 9 and 10) to hold content within the bag interior cavity 38. The closure adhesive strip 40 includes a pair of opposed adhesive strip distal ends 42, 43 formed and dimensioned to terminate proximate to a respective corner intersection 35, 36 of the bag assembly 20 such that a respective vent passage 45, 46 is formed between the adhesive strip distal ends 42, 43, in the closed condition, and the upper side edge end portions 32, 33 of the joined adjacent, respective opposed side edges 22, 23 of the side panels 21, 21'. Each the vent passage 45, 46 is of a lateral dimension sufficiently large to enable the venting of steam therethrough while being sufficiently small to prevent the passage of a human hand therethrough.

Accordingly, a wave bag assembly is provided that can be easily sealed to prevent visible tampering, yet provides venting of the contents simply by the positioning of the closure adhesive strip in such a manner to create the vent passages. This assembly is particularly useful in the food delivery service industry since the size of the vent passages, while providing venting of steam for example, is sufficiently small so that delivery personal cannot tamper with the bag contents without tearing of the bag or closure adhesive strip.

As best illustrated in FIGS. 1-3 and 5, each side panel 21, 21' is preferably identical in size and shape to one another such that when placed atop one another, in the folded condition, the side panel integral side edges 22, 23, the opposed parabolically shaped top edges 26, 26', and the respective opposed bottom edges 37, 37' are congruent. It will be appreciated, however, that while the opposed parabolically shaped top edges 26, 26' are preferably congruent, this is not a requisite. Furthermore, each plastic side panel is composed of a common plastic bag material, such as polyethylene, in typical sheet thickness in the ranges of between about 0.00035 inch to about 0.035 inch.

Using any conventional extrusion techniques, a single cylindrical unit can be extruded, folded, and stamped or cut, for instance, forming the congruent side panels 21, 21' of FIGS. 1-3. It will be appreciated, however, using conventional adhesive or heat seal techniques, or any other common edge joining method, the opposed side edges 22, 23 can be integrally joined, substantially forming the bag interior cavity 38.

With respect to the formation of the bottom portion of the wave bag assembly 20, a rectangular shaped bottom gusset portion 47 is disposed between the bottom edges 37, 37' of the respective side panels 21, 21'. This bottom gusset 47 facilitates the ability of the upper panel sections 25, 25' to stay in the opened condition (FIG. 5) while the remaining portions of the side panels are maintained in the receiving condition (FIGS. 5-10). Moreover, the bottom gusset provides a flatter bottom support when the food containers 49 are positioned therein.

The respective gusset side edges 48, 48' (FIGS. 1 and 4) are integrally joined with the respective adjacent panel bottom edges 37, 37' in the same or similar manner as the adjacent side panel side edges 22, 23. As best viewed in FIG. 4, the bottom gusset portion 47 includes a longitudinally extending central fold line 50 that is centrally disposed between the lower portions of the first and second side panels 21, 21'. Moreover, the opposed, folded gusset end edges 51, 51' are integrally joined together at the center fold line 50, and with the lower side edge portions 52, 53 of panel side edges 22, 23. Accordingly, when the bag assembly 20 is in the folded condition (FIGS. 1-5), the gusset portion 47 is completely folded. When the side panels 21, 21' are separated to the receiving condition (FIGS. 4 and 5, at least the central portions of the center fold line 50 are moved to an unfolded condition, while the integrally joined gusset end edges 51, 51' remain folded.

Once the upper panel sections 25, 25' of the wave bag assembly 20 are moved to the opened condition (FIGS. 4 and 5) and the side panels 21, 21' are moved to the receiving condition (FIG. 5), the one or more containers or cartons 49 can be stacked and/or placed side-by-side therein. In accordance with the present invention, and as mentioned above, the upper panel sections 25, 25' can then be repositioned to the closed position, and adhered together, via the closure adhesive strip 40, temporarily closing the upper panel sections together while retaining the container contents in the bag interior. The closure adhesive strip will maintain the closure of the bag assembly until forcibly opened and torn. Accordingly, a tamper proof seal is created, assuring both the food preparer/provider and the customer that content contained in the wave bag assembly 20 has not been tampered with.

The character and properties of the closure adhesive strip 40 is preferably similar to that of the relatively strong adhesives and adhesive tapes employed for those used on overnight delivery packages, for instance. That is, the adhesive strength must be sufficiently strong so that any attempt to open the sealed wave bag assembly would show visible signs of tampering (e.g., stretching, tearing, etc. of the bag material and/or closure adhesive strip). Suitable closure adhesive strip materials include, for example, 3M® 9086, 9888T, CT6348, 9088, 9088FL, and 55256 double-sided adhesive. One adhesive side of the closure adhesive strip 40 bearing a manually removable protective cover 54 (FIG. 8) that protects the adhesive until needed, as well as preventing inadvertent sealing of the upper panel sections 25, 25'.

Also in accordance with the present invention, at least one vent passage 45 is created between the closure adhesive strip 40 itself and the corresponding upper side edge end portion 32, 33 (most likely the corner intersection 35, 36) of the joined adjacent, respective opposed side edge 22, 23. This vent passage 45 enables the passage of steam, for example, emitted from the hot food contained in the containers 49 stored in the interior bag cavity 38. However, the vent passage 45 must also not be too wide so as to permit the passage of a human hand therethrough.

For example, the vent passage 45 is created between the at least one distal end portion of the closure adhesive strip 40 and the corresponding upper side edge end portion 32. However, the width of a flattened vent passage 45, when the bag assembly 20 is in the relaxed position, is significantly longer than a diameter of the vent passage, when generally circular, as when the bag assembly is in the receiving condition, and one tries to pass their hand therethrough. Accordingly, the range of permissible vent passage diameters is preferably in the range of about ½ inch to about 2½ inches in diameter, so a flattened Length ($L_v$) of the vent passage 45 (FIGS. 1, 2 and 12), when the bag assembly is in the folded condition, would translate to ½ of the vent passage circumference (i.e., when folded flat or $\frac{1}{2}\times\pi D$) or about 0.785 inch to 3.925 inches.

Figure 10:
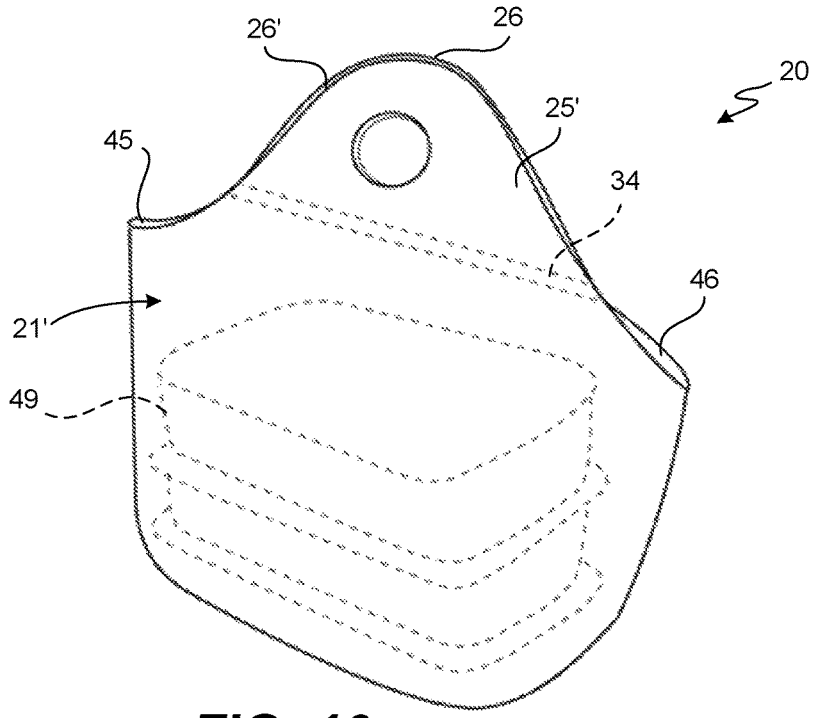
FIG. 10 is a top perspective view of the wave bag assembly of FIG. 9, showing the upper sections in the closed condition, while the remaining portions of the side panels maintain the contents of the bag assembly in the receiving condition.

Turning now to FIG. 10, although only one vent passage 45 has been described, preferably a pair of opposed vent passages 45, 46 are formed by the opposite adhesive strip distal ends 42, 43. More preferably, each vent passage 45, 46 is formed between a corresponding adhesive strip distal end 42, 43 and the adjacent upper side edge end portion 32, 33, and more likely the corresponding corner intersection 35, 36.

Preferably, the closure adhesive strip is provided by a single continuous strip generally spanning the horizontal distance from one upper side edge end portion 32 to the opposed upper side edge end portion 33 of the side panels 21, 21'. It will be appreciated, however, that the closure adhesive strip 40 could be provided by a plurality of aligned independent adhesive strip members (not shown) where the spacing therebetween complies with that of the vent passages 45, 46.

As best viewed in FIGS. 1, 2, 12 and 13, the shape of the closure adhesive strip 40 and/or the position of the opposed adhesive strip distal ends 42, 43 relative the corner intersection 35, 36 and the upper side edge end portions 32, 33 alters the ability close and seal the upper panel sections 25, 25' while maintaining the containers in the bag assembly 20 in the receiving condition. FIGS. 1 and 2 best represents the simplest closure adhesive strip 40 form and position extending horizontally near the intersection (i.e., an imaginary intersection line 55) between the upper panel section 25 and the middle panel section 56 of the first side panel 21 (FIG. 2), Since this positions the adhesive strip distal ends 42, 43 horizontally at the respective corner intersections 35, 36, the distal ends thereof must terminate within the flattened distances mentioned so as to create the proper sized vent passages 45, 46.

In the preferred embodiment, the closure adhesive strip 40 is positioned vertically above the imaginary intersection line 55, as best shown in the embodiments of FIGS. 1, 11, 12 and 14. In this manner, the closure adhesive strip 40 could extend horizontally and substantially all the way across the upper panel section 25, 25' with the opposed adhesive strip distal ends terminating at, or substantially at, the parabolic top edge 26, albeit at a vertical distance above the imaginary line 55 wherein the resulting hypotenuse length between the adhesive strip distal ends 42, 43 and the corner intersections. This length, of course should be no greater than the maximum flattened distance mentioned above to create the vent passages 45, 46.

Figure 11:
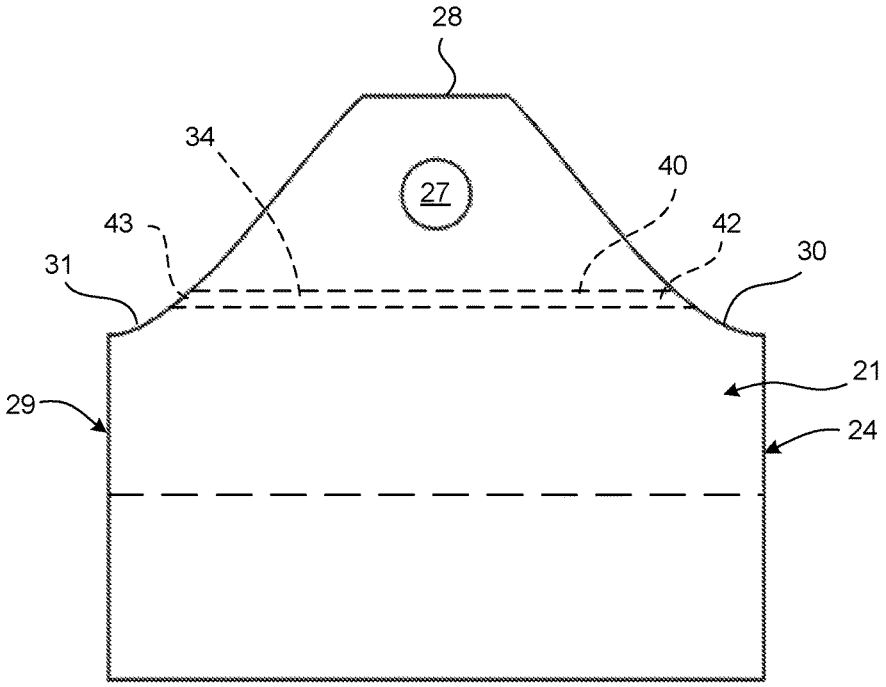
FIG. 11 is a front elevation view of alternative embodiment of the wave bag assembly of FIG. 1 with a horizontal apex portion of the upper section thereof.
Figure 14:
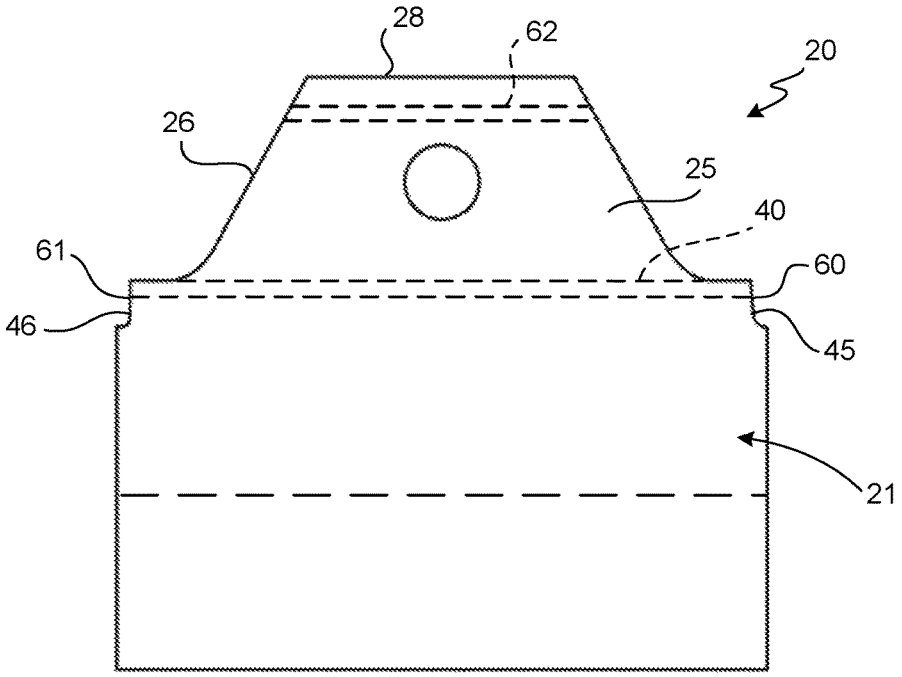
FIG. 14 is a front elevation view of alternative embodiment of the wave bag assembly of FIG. 1 with a horizontal apex portion of the upper section thereof, and with an additional single use or multiple use alignment adhesive strip
Figure 15:
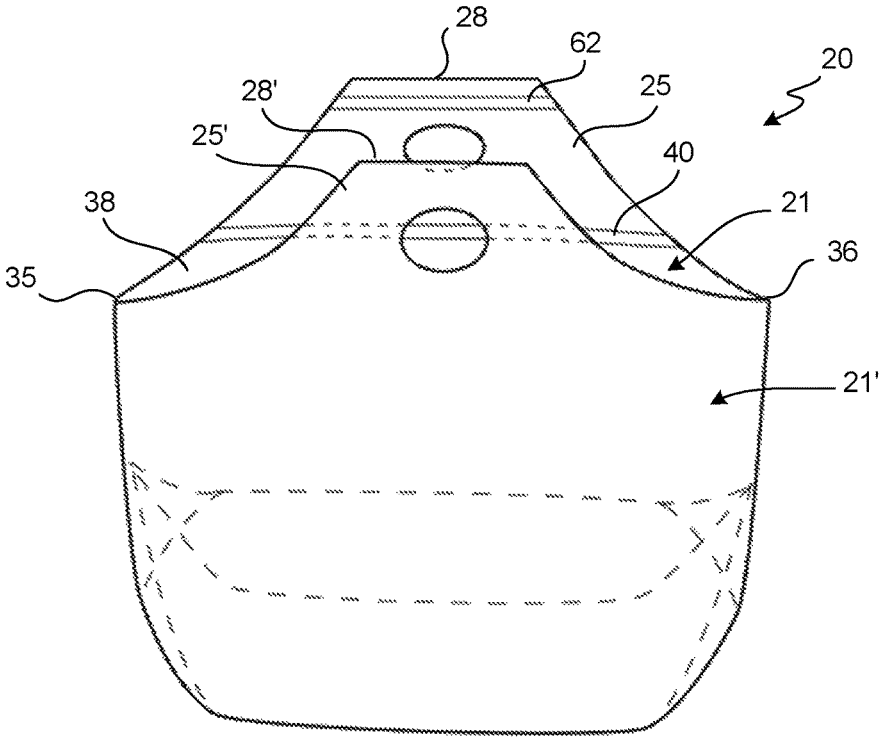
FIG. 15 is a top perspective view of alternative embodiment wave bag assembly of FIG. 14 with the upper sections thereof in an opened condition.
Figure 16:
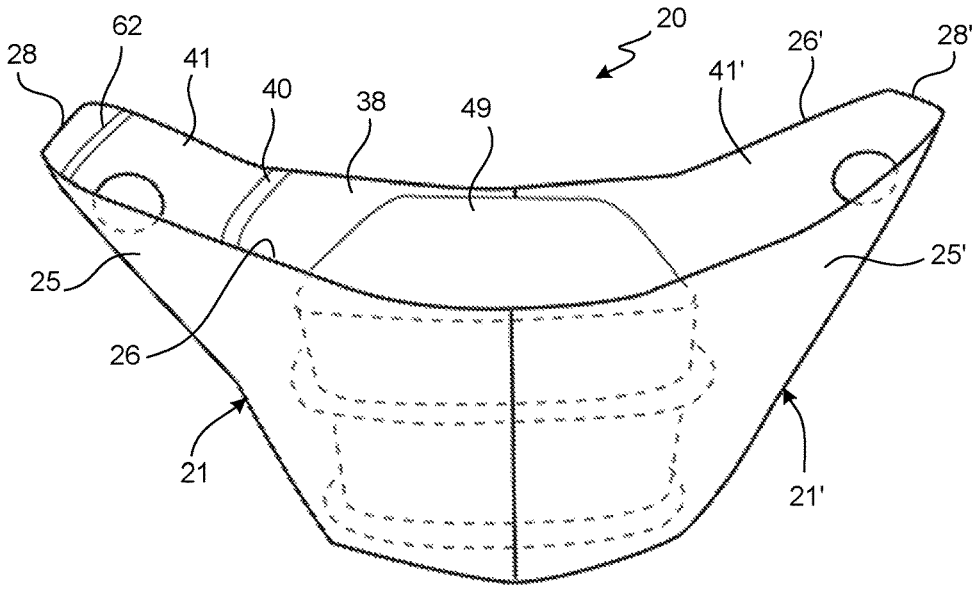
FIG. 16 is a top perspective view of alternative embodiment wave bag assembly of FIG. 15 with one or more containers placed in a bag interior thereof.
Figure 17:
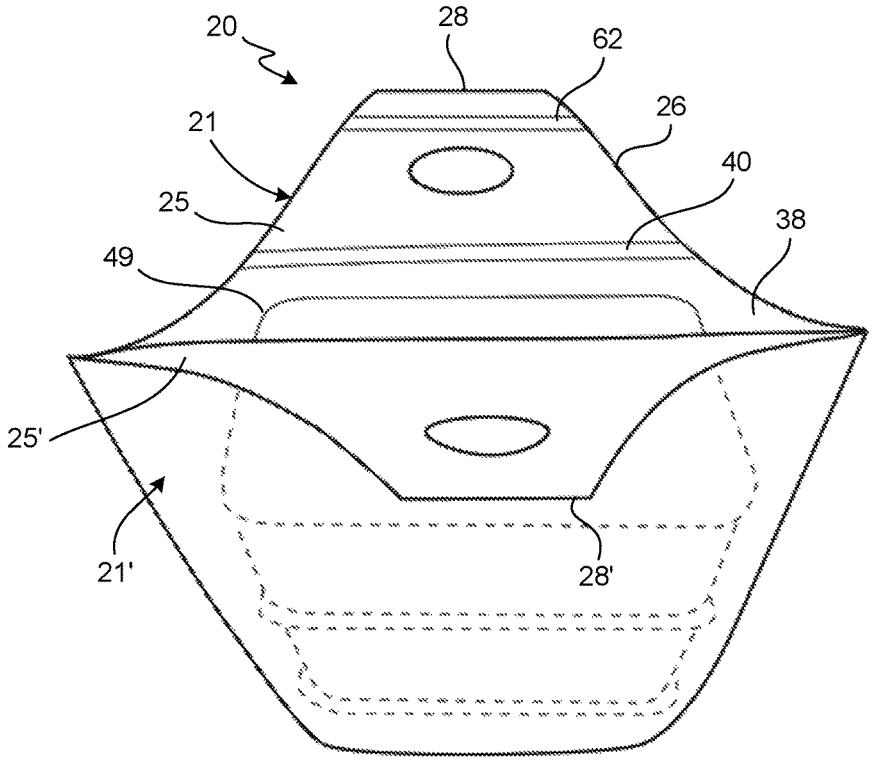
FIG. 17 is another top perspective view of alternative embodiment wave bag assembly of FIG. 15 with one or more containers placed in a bag interior thereof.
Figure 18:
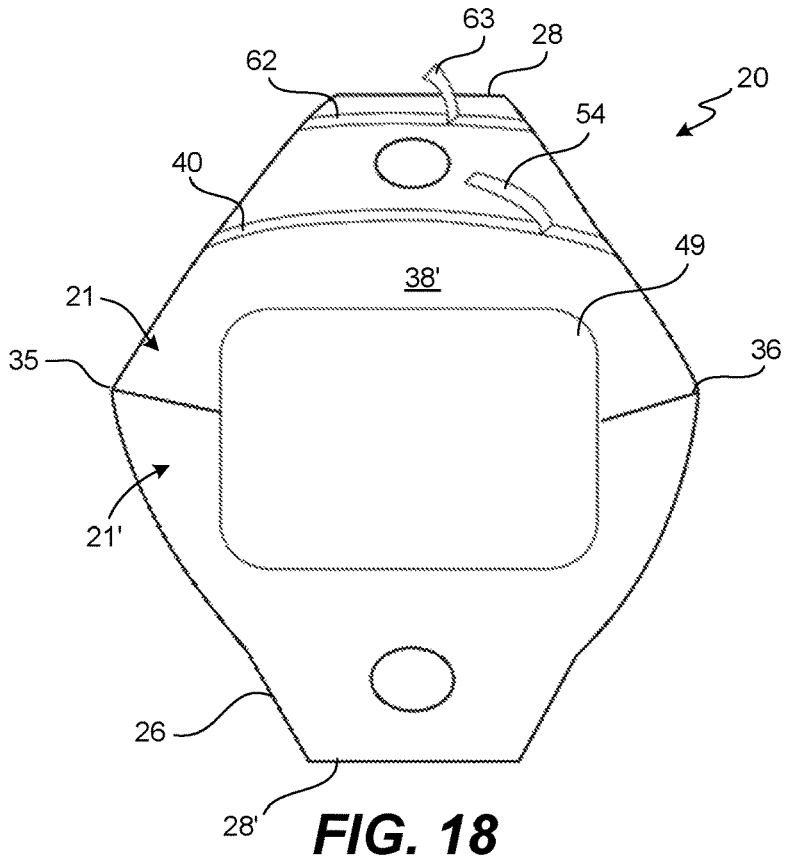
FIG. 18 is a top perspective view of the wave bag assembly of FIG. 16, showing removal of a protective cover over the single use or multiple use alignment adhesive strip and the closure adhesive strip.

In still another configuration, as best shown in FIGS. 11 and 14, the apex portions 28, 28' of the parabolically-shaped top edges 26, 26' can extends generally horizontally and linearly across the respective upper panel sections 25, 25'. This flattened apex portion 28, 28' is of course oriented above the respective handle apertures 27, 27'. Such a configuration also facilitates alignment of the apex portions 28, 28' for initial closure. Accordingly, this configuration is particularly useful when employed in conjunction with the upper single use or multiple use alignment adhesive strip embodiment to be described below.

Figure 12:
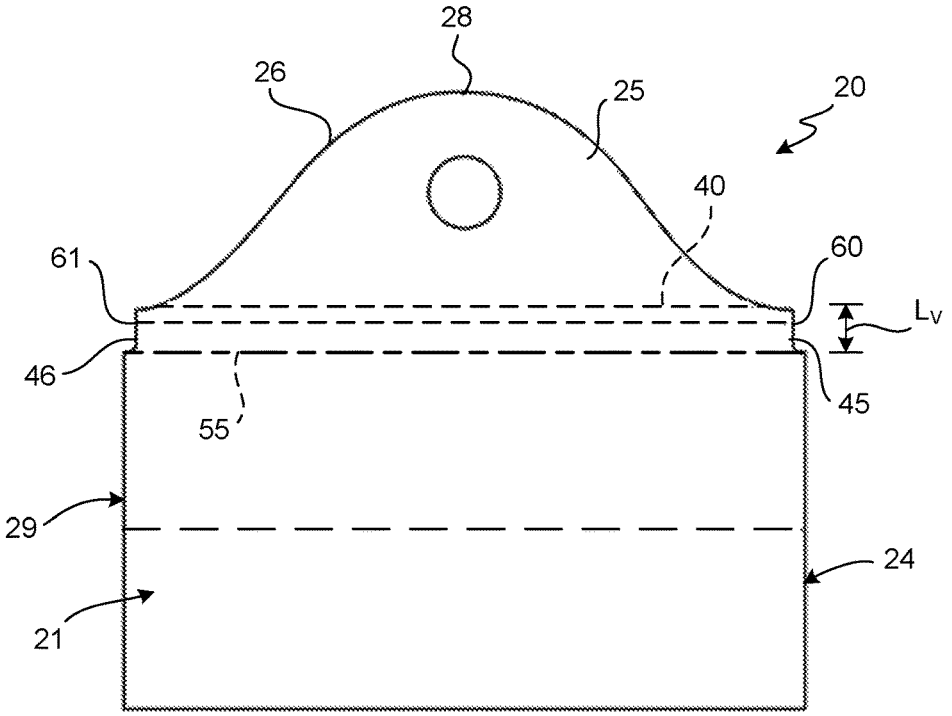
FIG. 12 is a front elevation view of another alternative embodiment of the wave bag assembly of FIG. 1 with a more vertically oriented vent passages.

Yet another specific embodiment provides a wave bag assembly 20 with vertically oriented vent passages, 45, 46, as best illustrated in FIGS. 12 and 14, defined by vertical cutouts 60, 61 which are cut out of the upper portions of the side edges 22, 23, as well as the opposed shoulder end portions of the parabolically shaped top edges 26, 26' of the upper panel sections 25, 25'. By orienting the vent passages 45, 46 more vertically, the steam vented can be direct out of the sides of the bag assembly rather then upwardly near the handles.

Figure 13:
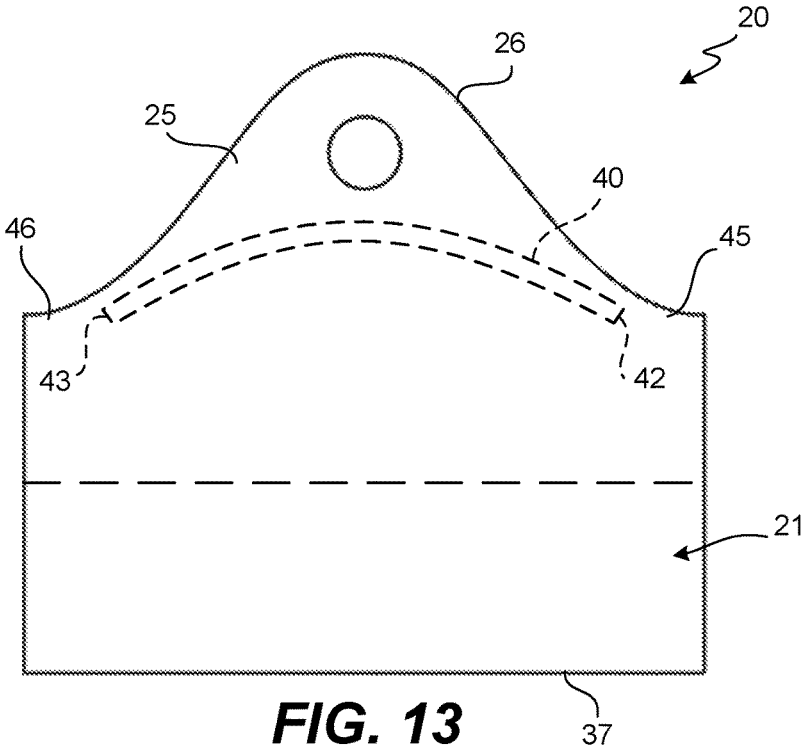
FIG. 13 is a front elevation view of alternative embodiment of the wave bag assembly of FIG. 1 with a parabolically shaped adhesive strip.

Referring now to FIG. 13, the closure adhesive strip 40 could be shaped generally similar to the parabolic curve of the top edge 26. This shape enables the middle section 56, 56' of the side panels 21, 21' to remain in a more open orientation when supporting the containers 49 therein, while the upper panel section 25, 25' remains sealed closed, via the closure adhesive strip 40. Accordingly, from the opposed adhesive strip distal ends 42, 43', the respective closure adhesive strip 40 tapers upwardly therefrom toward the apex portion 28, 28' of the top edge 26, 26'. It will be appreciated, however, that the apex of the closure adhesive strip 40 is positioned under the handle apertures 27, 27', of course.

In one configuration, the shape of the closure adhesive strip 40 is an inverted V-shape (not shown), while in another configuration, the shape of the closure adhesive strip 40 generally conforms to the parabolic shaped of the top edges 26, 26' (FIG. 13). Such an upwardly tapered closure adhesive strip 40 from the strip distal ends 42, 43 thereof, this design not only enables termination of the strip distal ends 42, 43 above the imaginary intersection line 55 (not shown), termination of the strip distal ends 42, 43 at the imaginary intersection line 55, but also enables termination of the strip distal ends 42, 43 below the imaginary intersection line 55 (FIG. 13) to create the corresponding vent passages 45, 46'.

Turning now to FIGS. 14-20, another embodiment is illustrated that includes an independent alignment adhesive strip 62 disposed and oriented laterally across the interior walls 41 of the upper panel section 25 of the first side panel 21. This alignment adhesive strip 62 is oriented above the handle aperture 27, and is configured to initially align the apex portions 28, 28' of the top edges 26, 26' for mounting together. Subsequently, this eases and simplifies the alignment and closure procedure of the closure adhesive strip 40, in the closed condition.

Figure 19:
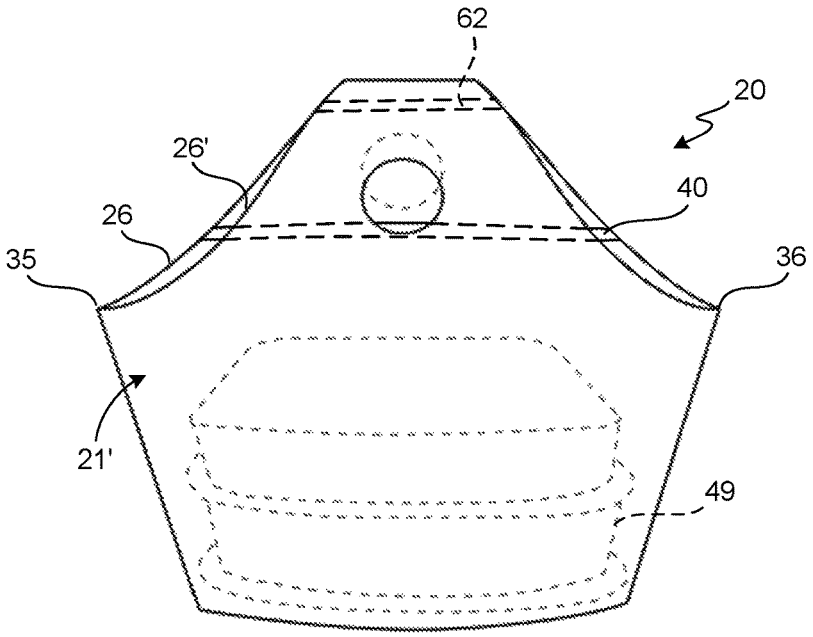
FIG. 19 is a top perspective view of the wave bag assembly of FIG. 18, showing alignment and adherence of the apex portions of the upper sections together, in an aligned condition, with the single use or multiple use alignment adhesive strip.
Figure 20:
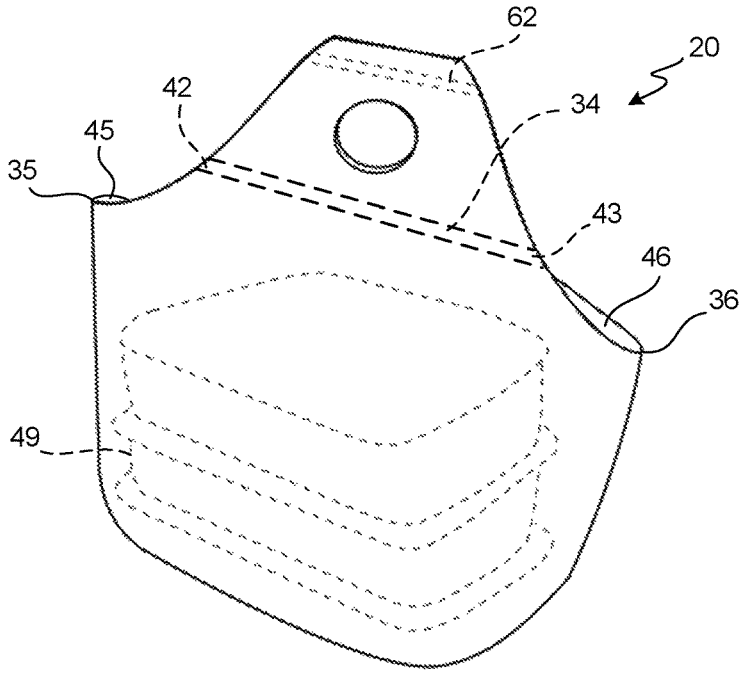
FIG. 20 is a top perspective view of the wave bag assembly of FIG. 19, showing adherence of the upper sections together, in a closed condition, with the closure adhesive strip and formation of the vent passages.

Similar to the closure adhesive strip 40, the alignment adhesive strip can be provided by single use or multiple use double sided tape, or other forms of adhesives commonly employed for these purposes. Typically, for instance, the protective cover 63 from over the alignment adhesive strip can be removed (FIG. 18), and then the apex portions 28, 28' of the upper panel sections 25, 25' can be initially aligned. However, if initially not aligned straight, the realignment can be achieved from the multiple use alignment adhesive strip. Once aligned, the alignment adhesive strip 62 can be pressed against the opposing interior walls 41' of the upper panel section 25' of the second panel 21' (FIG. 19). The adhered alignment strip 62 subsequently facilitates the alignment and closure of the closure adhesive strip 40 to the opposed interior walls 41' of the second side panel 21' (FIG. 20).

Figure 24:
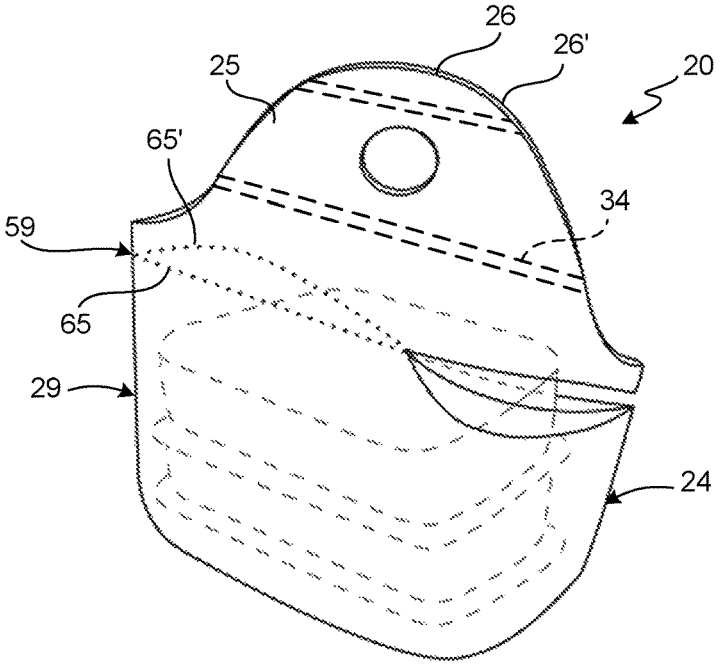
FIG. 24 is a top perspective view of the wave bag assembly of FIG. 23, illustrating opening of a closed bag assembly.

FIGS. 21-24 best illustrate another sealable wave bag assembly embodiment having a perforation 65 (and/or 65') extending substantially across at least one of the first and second side panels 21, 21' to facilitate opening of the wave bag assembly 20 to retrieve its contents, once sealed. Preferably each side panel 21, 21' includes a perforation 65, 65' extending substantially across each side panel 21, 21, and preferably each perforation 65, 65' is congruent to one another to promote tearing open the perforations in a manner similar to opening a bag of potato chip for example (FIG. 24). It will be understood, however, that a single perforation 65 (FIG. 25) is acceptable.

Figure 21:
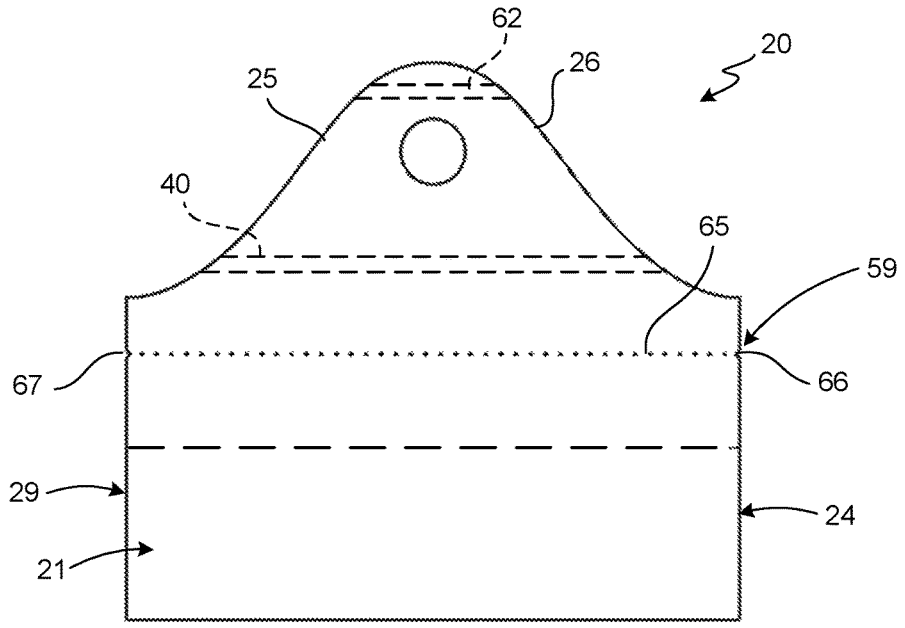
FIG. 21 is a front elevation view of another embodiment of the wave bag assembly of FIG. 1 with a perforation.
Figure 22:
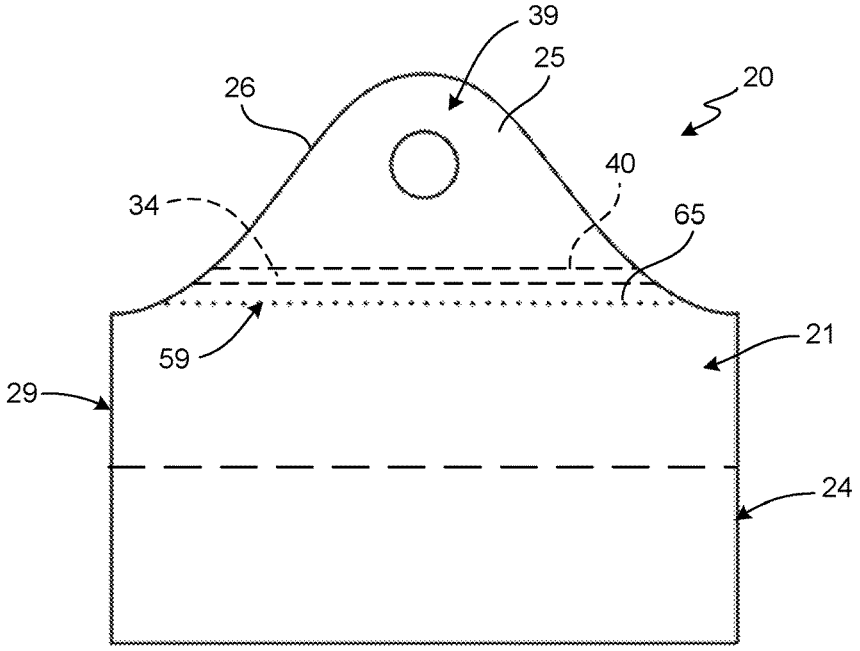
FIG. 22 is a front elevation view of another embodiment of the wave bag assembly of FIG. 21 with an alternative position of the perforation.
Figure 23:
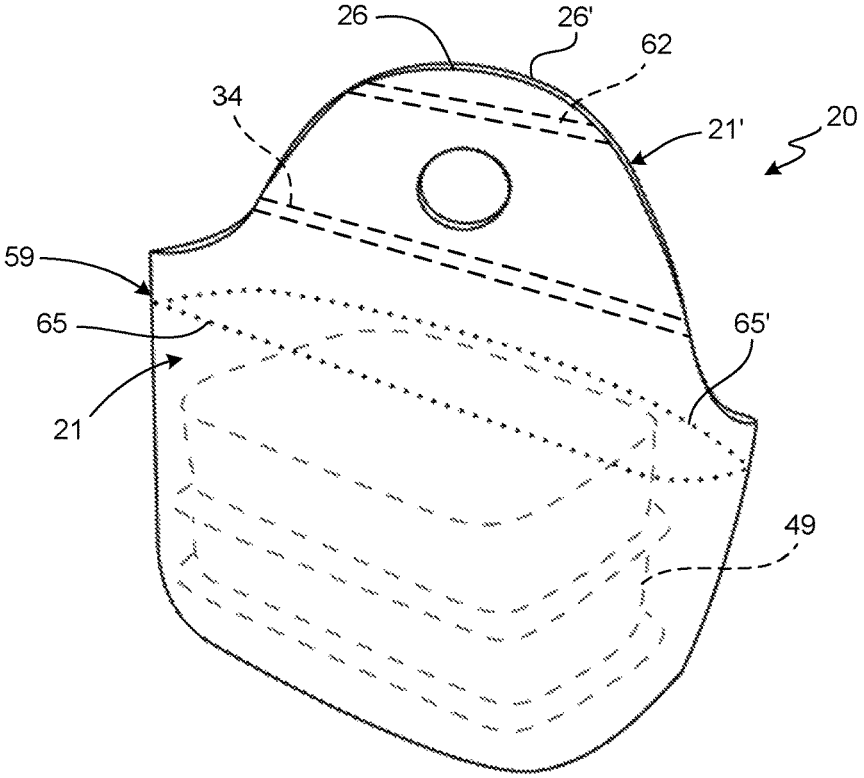
FIG. 23 is a top perspective view of the wave bag assembly of FIG. 21.

The placement of these opposing perforations 65, 65' must be oriented below the closure adhesive strip 40 of course. As best shown in FIG. 21, in one embodiment, the perforations 65, 65' extend from one side edge 22 of the corresponding side panel 21, 21' to the opposed side edge 23 thereof. In another embodiment, the perforations 65, 65' extend substantially across the corresponding upper panel sections 25, 25' from one side of the respective parabolic top edge 26, 26' to an opposite side of the top edge thereof (FIG. 22).

The perforations 65, 65' can be created using conventional mechanical and/or laser cutting techniques. Moreover, while the perforations 65, 65' are substantially linear and oriented substantially horizontal, it will be appreciated that the perforations can be non-linear, and can even be oriented vertically along the side panels 21, 21' (e.g., down at least one of the side edge 22, 23, although not shown).

Figure 25:
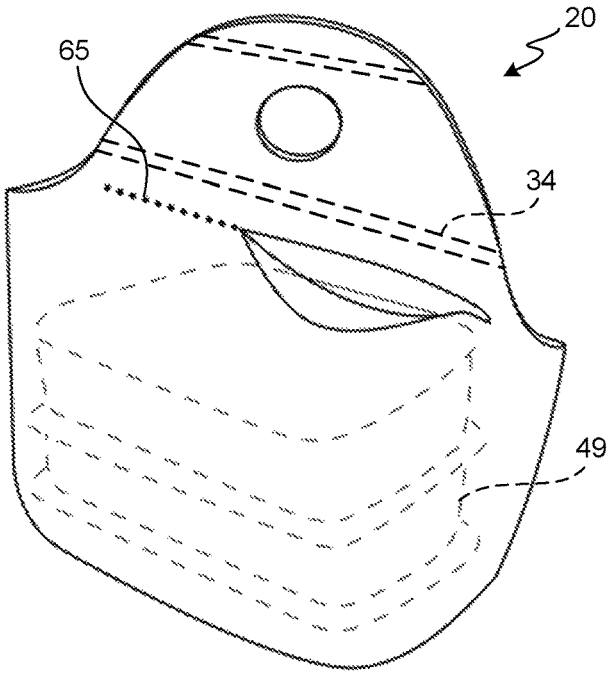
FIG. 25 is a top perspective view of an alternative embodiment perforation for the wave bag assembly of FIG. 21.

In accordance with this aspect of the present invention, to open the wave bag assembly 20 when the closure adhesive strip 40 is selectively maintaining the upper panel sections 25, 25' generally in the closed condition (FIGS. 9 and 10), the perforations can be compromised by forcibly tearing open one side of the side panels (FIG. 25). When there is a set of congruent, opposed perforations 65, 65', tearing of the side panels may be performed more easily together and simultaneously (FIG. 24).

As best illustrated in FIG. 21, a set of tabs or cutouts 66, 67 may be included that are aligned with the terminating ends of the perforations 65, 65'. These cutouts 66, 67 facilitate commencement of the perforation tear at the ends thereof.

Figure 5:
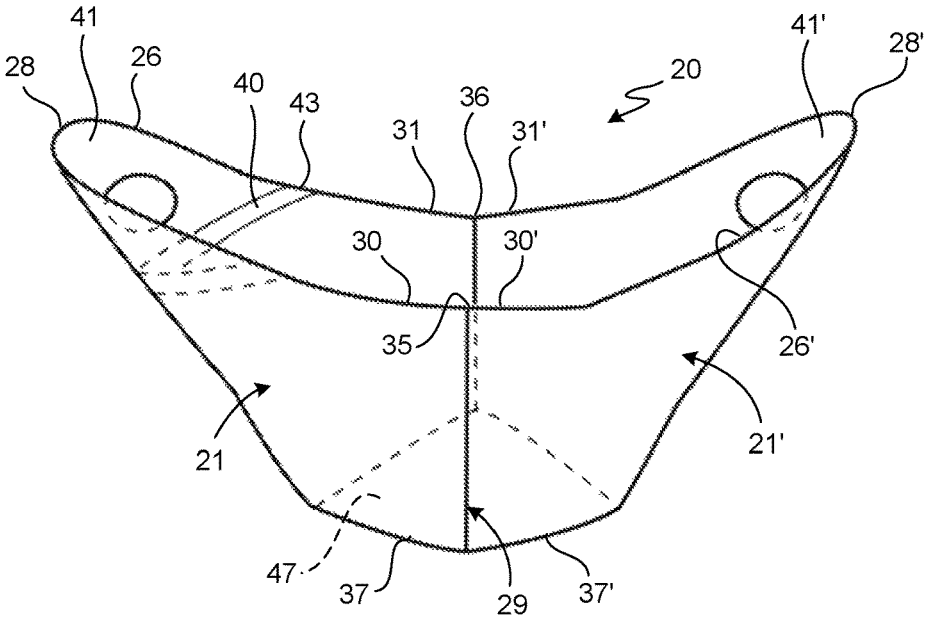
FIG. 5 is a top perspective view of the wave bag assembly of FIG. 4 with the first and second side panel thereof in a receiving condition.
Figure 6:
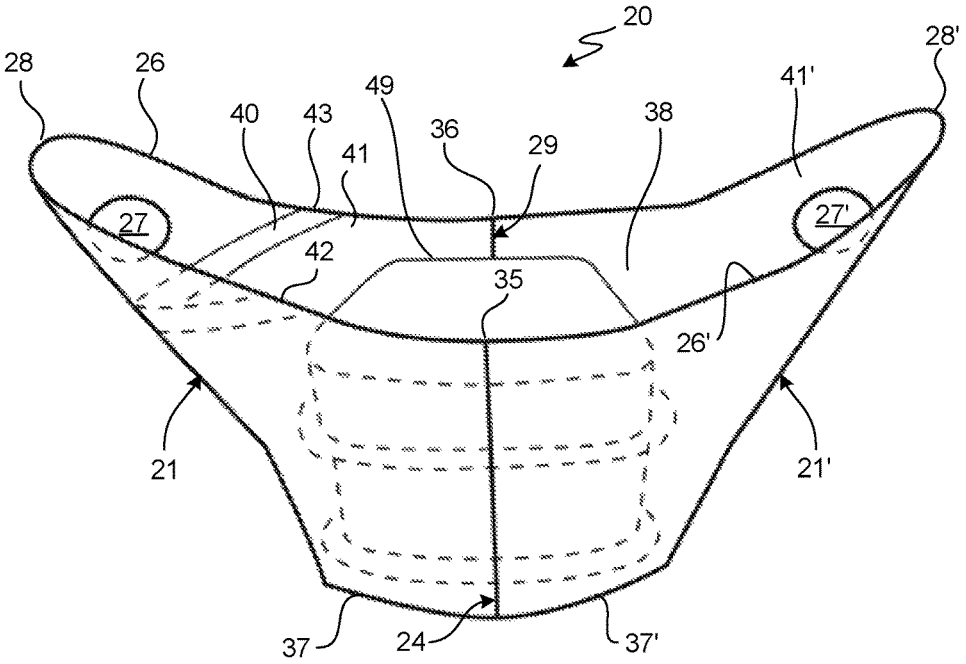
FIG. 6 is a top perspective view of the wave bag assembly of FIG. 5 with one or more containers placed in a bag interior thereof.
Figure 7:
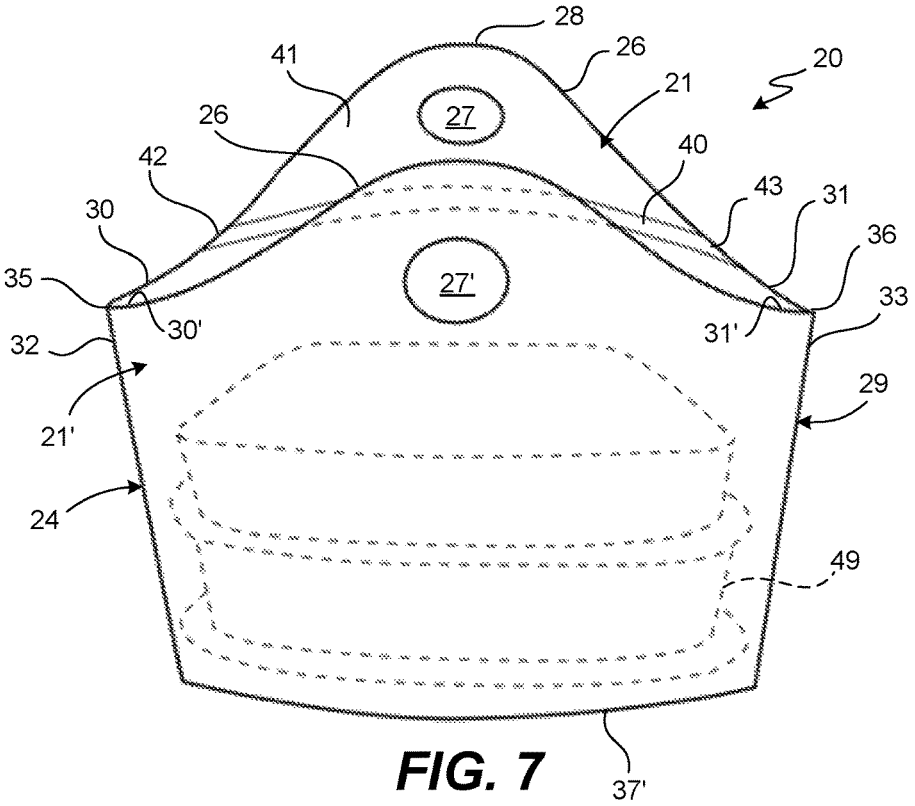
FIG. 7 is a top perspective view of the wave bag assembly of FIG. 6 with commencement of the upper sections of the side panels moved toward a closed condition.
Figure 8:
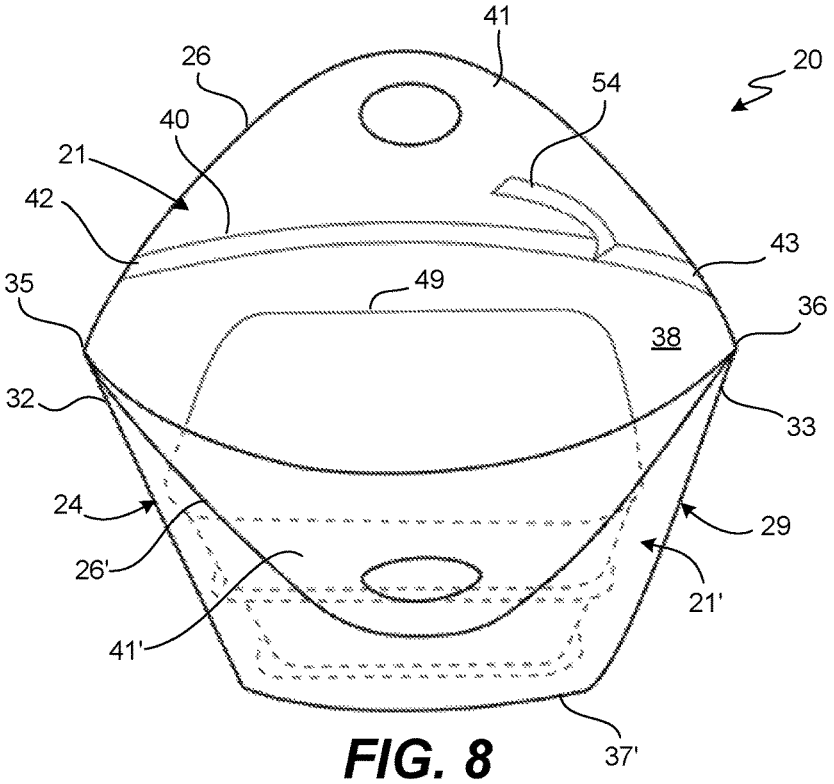
FIG. 8 is a top perspective view of the wave bag assembly of FIG. 7, showing removal of a protective cover over the closure adhesive strip.
Figure 9:
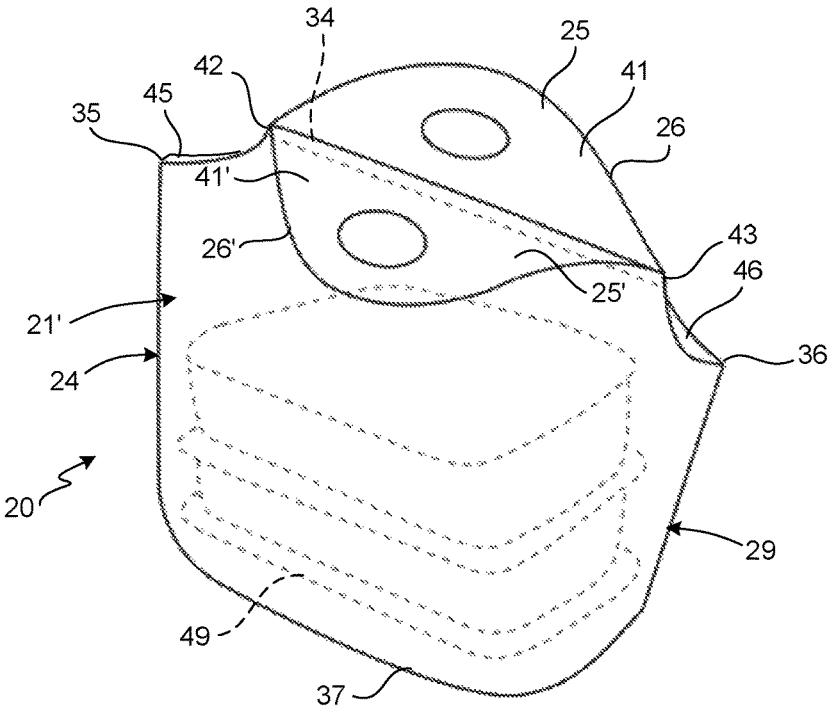
FIG. 9 is a top perspective view of the wave bag assembly of FIG. 8, showing adherence of the upper sections together, in a closed condition, and formation of the vent passages.

Yet another aspect of the present invention provides a tamper proof method for transporting one or more food containers 49 which includes is providing a plastic material wave bag assembly 20 as described above, having a sheet-like first side panel 21 and a sheet-like side panel 21 oriented in opposed congruent relationship to one another when in a folded condition (FIGS. 1-3), and repositioning the wave bag assembly 20 from the folded condition to the opened condition (FIGS. 4 and 5), reorienting the first and second side panels 21, 21' to the receiving condition (FIG. 5). The method further includes placing the one or more food containers 49 into the bag interior cavity 38 in the receiving condition (FIGS. 6 and 7). The next step includes single-use, substantially sealing the opposed upper panel sections 25, 25' together to a closed condition (FIGS. 9 and 10), toward the folded condition, while the one or more food containers are maintained in the bag interior cavity 38 in the receiving condition by contacting a single use closure adhesive strip 40 into contact with the opposed interior walls 41' of the opposed upper panel section 25'.

Similarly, the closure adhesive strip is formed and dimensioned to facilitate the creation of at least one vent passage. The opposed upper panel sections are maintained in the closed condition, and the vent passage is of a lateral dimension sufficiently large to enable the venting of steam therethrough from the bag interior while being sufficiently small to prevent the passage of a human hand therethrough.

In another specific embodiment, before forming the pair of opposed vent passages 45, 46, aligning the respective apex portions 28, 28' of the upper panel sections 25, 25' together. Next, the method includes contacting a single use or multiple use alignment adhesive strip 62, disposed on the interior wall 41 of the upper section 25 of the first side panel 21, oriented above the handle apertures 27, and into contact with the opposed interior wall 41' of the second side panel 21'.

While the present invention has been described in connection with the preferred form of practicing it and modifications thereto, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

What is claimed is:

1. A top opening, tamper evident, polyethylene plastic prepared food or beverage delivery bag comprising:

a plastic sheet folded to form opposing first and second panels of the plastic delivery bag and a bottom gusset, each panel having an internal surface that faces the opposing panel, an exterior surface, and a wave top upper portion, the first and second panels having substantially identical footprints;

a first seam that secures the first panel to the second panel on a first side edge of the plastic delivery bag;

a second seam that secures the first panel to the second panel on a second side edge of the plastic delivery bag, the first and second seams cooperating with the first and second panels and the bottom gusset to form the top opening bag with a content receiving region between the panels, and wherein the wave top upper portions of the first and second panels are at a level that is higher on the plastic delivery bag than the top ends of the first and second seams and all regions of the first and second panels above the first and second seams are narrower in width than a width between the first and second seams;

a laterally extending single use closure adhesive strip disposed on the internal surface of the wave top upper portion of the first panel, the adhesive strip being positioned opposite an opposing portion of the internal surface of the wave top upper portion of the second panel, wherein the adhesive strip extends continuously across the wave top upper portion of the first panel between opposite edges of the wave top upper portion of the first panel;

a removable protective strip that covers the adhesive strip, the protective strip being positioned on the first panel at a level that is higher than top ends of the first and second seams, the plastic delivery bag being configured such that when the protective strip is removed, and the adhesive strip is brought into contact with the opposing portion of internal surface of the second panel a seal is formed that closes the plastic delivery bag and a first vent is formed between the top of the first seam and the seal and a second vent is formed between the top of the second seam and the seal, the vents extending laterally inward from their associated seams along a top edge of the wave top upper portions of the panels, wherein the vents are sufficiently large to enable the venting of steam there through while being sufficiently small to prevent the passage of a human hand there through, and wherein the seal is formed between the internal surfaces of the first and second panels at a level that is higher on the plastic delivery bag than the top ends of the first and second seams; and a tear feature positioned at a level that is lower on the plastic delivery bag than the adhesive strip, the tear feature being configured to facilitate opening the plastic delivery bag after the plastic delivery bag has been sealed to thereby provide access to the content receiving region of the plastic delivery bag; and a handle formed as cut-outs in upper portions of the first and second panels at a location above the adhesive strip.

2. A top opening, tamper evident plastic delivery bag comprising:

a plastic sheet folded to form opposing first and second panels of the plastic delivery bag and a bottom gusset, each panel having an internal surface that faces the opposing panel and an exterior surface;

a first seam that secures the first panel to the second panel on a first side edge of the plastic delivery bag;

a second seam that secures the first panel to the second panel on a second side edge of the plastic delivery bag, the first and second seams cooperating with the first and second panels and the bottom gusset to form the top opening bag with a content receiving region between the panels;

a laterally extending single use closure adhesive strip disposed on the internal surface of the first panel, the adhesive strip being positioned opposite an opposing portion of the internal surface of the second panel and wherein the adhesive strip is positioned on the first panel at a level that is higher on the plastic delivery bag than top ends of the first and second seams;

a removable protective strip that covers the adhesive strip, the plastic delivery bag being configured such that when the protective strip is removed, and the adhesive strip is brought into contact with the opposing portion of internal surface of the second panel a seal is formed between the internal surfaces of the first and second panels at a level that is higher on the plastic delivery bag than the top ends of the first and second seams that closes the plastic delivery bag and a first vent is formed between the top of the first seam and the seal and a second vent is formed between the top of the second seam and the seal, wherein the vents are sufficiently large to enable the venting of steam there through while being sufficiently small to prevent the passage of a human hand there through; and the adhesive strip and the removable protective strip each extend continuously across the first panel between opposite edges of the first panel; and a tear feature positioned at a level that is lower on the plastic delivery bag than the adhesive strip, the tear feature being configured to facilitate opening the plastic delivery bag after the plastic delivery bag has been sealed to thereby provide access to the content receiving region of the plastic delivery bag; and a handle arranged to be gripped by a user at a location above the adhesive strip after the seal is formed to facilitate carrying the plastic delivery bag, wherein the handle does not provide access to the content receiving region of the sealed plastic delivery bag.

3. The tamper evident plastic delivery bag as recited in claim 2 wherein:

the plastic delivery bag is a wave top plastic delivery bag and each panel has a wave upper portion at a level that is higher on the plastic delivery bag than the top ends of the seams;

the adhesive strip is disposed on the wave upper portion of the first panel; and the vents extend laterally inward from their associated seams along a top edge of the wave upper portions of the panels.

4. The tamper evident plastic delivery bag as recited in claim 3 wherein the tear feature is at a level that is lower on the plastic delivery bag than the top ends of the seams.

5. The tamper evident plastic delivery bag as recited in claim 3 further comprising a die cut handle formed in the wave upper portions of the first and second panels at a location above the adhesive strip.

6. The tamper evident plastic delivery bag as recited in claim 3 wherein the tear feature includes at least one of a perforation and a tear notch.

7. The tamper evident plastic delivery bag as recited in claim 2 wherein: all upper portions of the first and second panels that are at a level that is higher on the plastic delivery bag than the top ends of the first and second seams, including the portions of the internal surface of the first panel that underlie the adhesive strip, are narrower in width than a width between the first and second seams; and whereby no portion of the adhesive strip or the removable protective strip are positioned directly above the top end of either of the first and second seams.

8. The tamper evident plastic delivery bag as recited in claim 2 wherein the first and second panels have substantially identical footprints and no portion of the removable protective strip extends beyond the footprint of the first and second panels.

* * * * *